US006205608B1

(12) United States Patent
Bowen

(10) Patent No.: US 6,205,608 B1
(45) Date of Patent: Mar. 27, 2001

(54) DECK CREVICE CLEANING TOOL

(76) Inventor: Lee M. Bowen, 6612 "B" St., Springfield, OR (US) 97478

( * ) Notice: Subject to any disclaimer, the term of this patent is extended or adjusted under 35 U.S.C. 154(b) by 0 days.

(21) Appl. No.: 09/327,974

(22) Filed: Jun. 8, 1999

(51) Int. Cl.[7] ..... A47L 13/00

(52) U.S. Cl. ..... 15/104.001; 15/236.01; 30/170

(58) Field of Search ..... 15/104.001, 143.1, 15/236.01, 236.05, 236.06, 236.07, 236.08, 236.09, 246; 56/400.04, 400.05, 400.08, 400.09; 30/170; 294/19.1

(56) References Cited

U.S. PATENT DOCUMENTS

| | | | | |
|---|---|---|---|---|
| 4,358,123 | * | 11/1982 | Richards | 15/246 |
| 5,054,278 | * | 10/1991 | Thorndike . | |
| 5,058,275 | * | 10/1991 | Staubli | 30/170 |
| 5,471,696 | | 12/1995 | Linfoot . | |
| 5,666,683 | | 9/1997 | Gairdner . | |
| 5,740,577 | * | 4/1998 | Wade | 15/236.01 |
| 5,813,083 | * | 9/1998 | Gould | 15/236.01 |
| 5,850,657 | * | 12/1998 | List et al. | 15/236.01 |

FOREIGN PATENT DOCUMENTS

| | | | | |
|---|---|---|---|---|
| 686661 | * | 4/1930 | (FR) | 15/236.01 |
| 2277900 | * | 11/1994 | (GB) | 15/236.01 |

* cited by examiner

*Primary Examiner*—Terrence R. Till
(74) *Attorney, Agent, or Firm*—Robert E. Howard

(57) ABSTRACT

A tool for removing debris from the space between adjacent planks of a deck. The tool has a blade attached to a handle, the blade having a thickness less than the space between the deck planks. A pair of wheels for contacting the upper planar surfaces of adjacent deck planks are rotatably mounted on said blade to allow the tool to be pushed by the handle along a deck with the blade inserted into the space between the adjacent deck planks. The leading edge of the blade is angled to a tip, and the ratio of the distance between the tip and wheels, and the distance between the wheels and the outer end of the handle is between about 1:12 and about 1:20.

6 Claims, 2 Drawing Sheets

DECK CREVICE CLEANING TOOL

BACKGROUND OF THE INVENTION

This invention relates to a deck crevice cleaning tool for cleaning debris from the space between adjacent deck planks.

Many homes have outdoor decks that are constructed of wooden decking planks, such as cedar or redwood, attached to joists. The decking planks are usually 2×6 inch dimensional lumber, and adjacent planks are spaced apart a distance of between about ⅛ to about ⅜ inch to allow for drainage, ventilation, and the natural expansion and contraction of the wood.

Over a period of time debris, such as leaves, pine needles, etc. accumulate in the spacing between adjacent deck planks. Such debris must be removed to minimize deterioration of the decking.

People use knives, screwdrivers, or other hand tools to remove such debris. The use of such tools requires kneeling down, and is laborious and time consuming.

Several specialized tools have been suggested for removing such debris which allow the operator to stand up. Such devices typically employ a hook member inserted between adjacent planks which is used to pull debris therefrom. Such devices require a back and forth movement, and require frequent cleaning of debris from the tool.

Several prior art devices are disclosed in U.S. Pat. Nos. 5,471,696 and 5,666,683.

SUMMARY OF THE INVENTION

It is an object of this invention to provide a deck cleaning tool that is efficient and easy to use.

The deck cleaning tool of this invention has a cleaning blade attached to a handle, the blade having a thickness less than the space between the adjacent deck planks of a deck to be cleaned. A pair of wheels for contacting the upper surfaces of the adjacent deck planks are rotatably mounted on the blade to allow the tool to be pushed along a deck by the handle with the forward end of the blade positioned between the planks with the tip extending at least to the bottom of the adjacent planks. The leading edge of the blade is angled to a tip.

DESCRIPTION OF THE PREFERRED EMBODIMENTS

Figure 1:
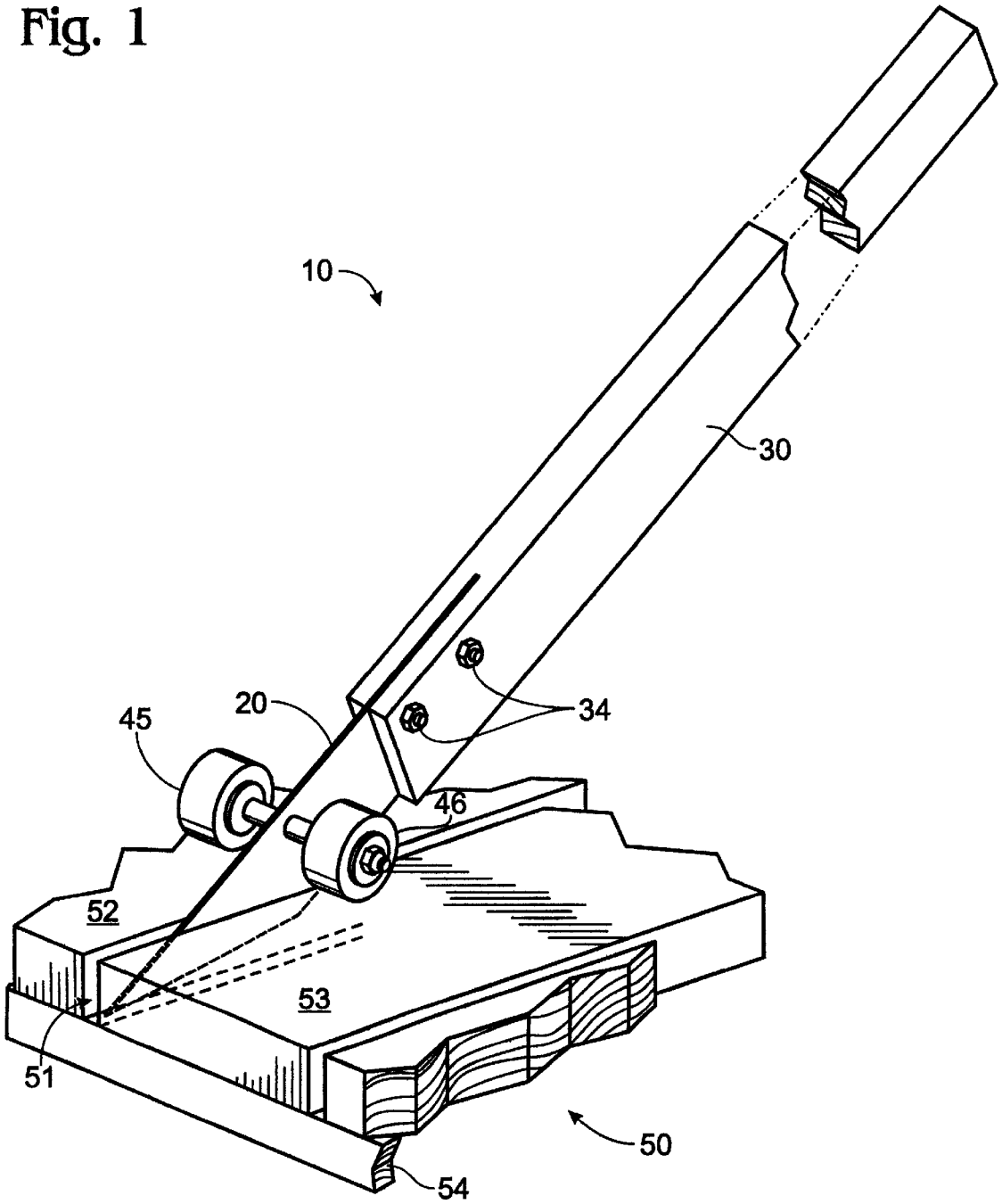
FIG. 1 is a perspective view, partially in section, showing the deck cleaning tool of the invention in its cleaning position on a deck.

The deck cleaning tool 10 of the invention is comprised of a blade 20 attached to a handle 30. A wheel subassembly 40 is attached to blade 20 in a manner to be described.

Blade 20 has two opposing planar surfaces forming the sides of the blade. The blade 20 has a back edge 22, a bottom edge 23, an angled leading edge 24, and a trailing edge 25.

Holes 26 and 27 extending through the sides of blade 20 provide openings for fastening members, such as nuts and bolts, used for attaching blade 20 to handle 30. Hole 28 provides an opening for attaching wheel subassembly 40.

Blade 29 has a tip 29 formed at the juncture of leading edge 24 and back edge 22.

Blade 20 has a thickness that will allow it to fit into the space between decking planks, preferably about ⅛ inch.

Wheel subassembly 40 is comprised of a tubular axle 41 which passes through hole 28 in blade 20 and is permanently attached to blade 20 by a weldment 42 or other suitable fastening means. A threaded rod 43 passes through the interior of tubular axle 41 and extends beyond both ends thereof, as shown. A first tubular spacer 44*a* is placed over one end of tubular axle 41 and a second tubular spacer 44*b* is placed over the other end of tubular axle 42. First and second wheels 45 and 46 are rotatably placed onto the ends of axle 41, as shown, and held against tubular spacers 43 and 44 by nuts 47 and 48, respectively.

Figure 2:
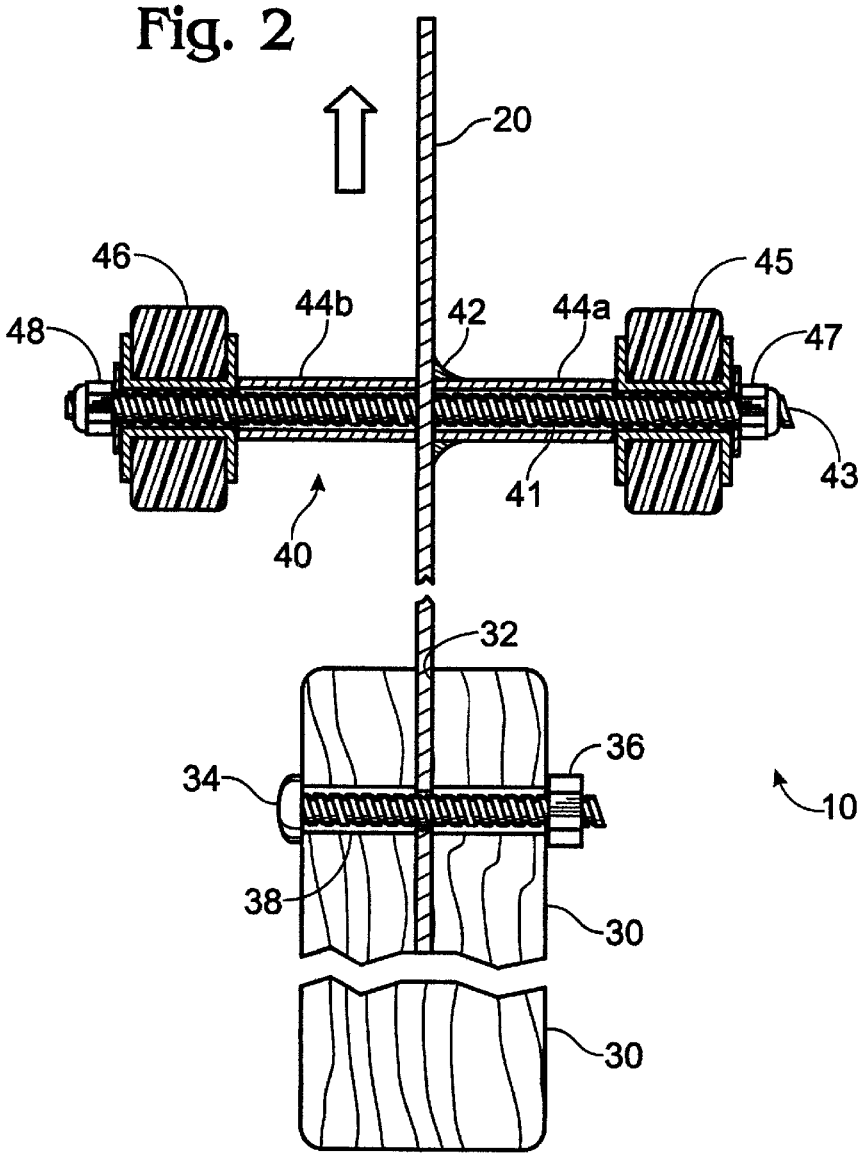
FIG. 2 is a top view in cross-section of the deck cleaning tool of the invention.
Figure 3:
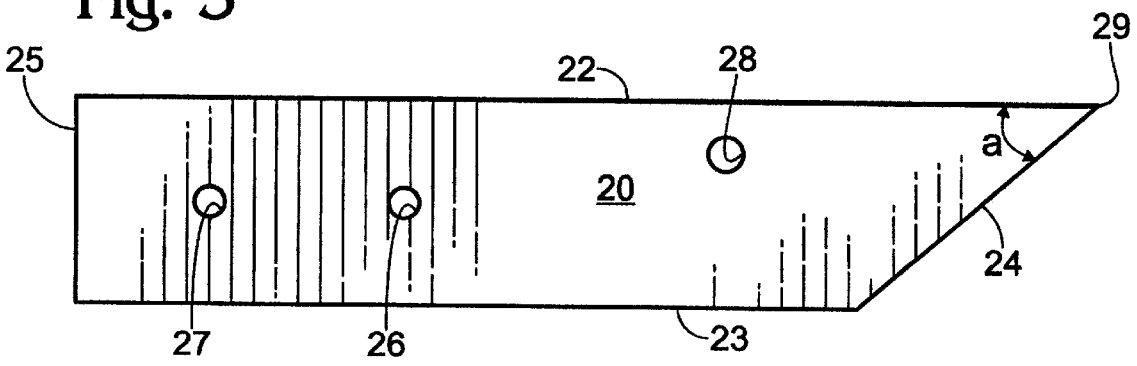
FIG. 3 is a side view of the cleaning blade of the deck cleaning tool of the invention.

Handle 30 has a slot 32 cut in the lower end thereof to receive the rear portion of blade 20. Blade 20 is affixed to handle 30 by means of two bolts 34 and two nuts 36, only one set of which is shown in FIG. 2, which pass through two openings 38 (only one of which is shown) in the lower end of handle 30. Openings 38 align with holes 26 and 27 of blade 20 to allow bolts 34 to pass therethrough for attachment of blade 20 to handle 30.

The use of the deck cleaning tool 10 to clean a deck 50 is illustrated in FIG. 1. Blade 20 is inserted into the space 51 between adjacent decking planks 52 and 53 with wheels 45 and 46 contacting the upper surface of the adjacent planks, as shown. The operator holds onto the upper end of handle 30 and pushes tool 10 forward (to the left in FIG. 1 and in the direction of the arrow shown in FIG. 2).

The distance between the bottoms of wheels 45 and 46 and tip 29, and the angle of leading edge 24 of blade 20, is selected such as to make the tip 29 of leading edge 24 extend at least to, or just below, the bottom of planks 52 and 53 when handle 30 is being held in its operating position by a person of normal stature.

The angle of leading edge 24 is also selected such that when the tip 29 approaches or contacts a joist 54 of deck 50, rotation of tip 29 upwardly, by lowering handle 30, causes the leading edge 24 to clear the joist as the blade 30 passes thereover.

The angle "a" between leading edge 24 and the back edge 22 of blade 20 is preferably between about 35 and about 40 degrees.

The distance between tip 29 and the juncture of axle 41 with blade 20 is preferably about 3 inches.

Wheels 45 and 46 are preferably spaced a distance away from blade 30 sufficient to stay clear of any debris plowed up onto the tops of deck planks 52 and 53 in operation. Wheels 45 and 46 are preferably made of plastic (such as nylon) so they won't rust, but may be made of metal or other material.

The ratio of the distance of the tip 29 to the location of the juncture of axle 41 and blade 20 (the fulcrum point) in relationship to the distance between the axle 41 to the upper (outer) end of the handle 30 causes a great amount of leverage to be applied by the blade 20 to the debris to be removed.

A leverage ratio of about 1:16 has been found to provide excellent debris removal ability for deck cleaning device 10. This ratio will be present where the distance between the tip 29 and axle 41 is about 3 inches and the distance between axle 41 and the outer end of handle 30 is about 48 inches. However, other leverage ratios may be employed, preferably between about 1:12 to about 1:20.

A shorter handle length (i.e., the distance from axle 41 to the outer end of handle 30) of about 38 inches may be desirable for purposes of shipping the device.

Deck cleaning device 10 acts as a plow in operation, with tip 29 and back edge 22 of blade 20 loosening debris located in crevice 51 and causing it to be pushed up along the back 22 of blade 20 where it is ejected out of the crevice 51 and pushed onto the tops of adjacent planks 52 and 53 for easy collection and removal.

The height of the blade 20, i.e., the distance between back edge 22 and bottom edge 23, should be sufficient to prevent debris from reentering space 51. A desirable height has been found to be about 1.5 inches.

The deck cleaning tool 10 of the invention is easily pushed the entire length of a deck crevice at a normal walking pace in a continuous forward motion, eliminating the back and forth motion and frequent cleaning required by other deck cleaning tools.

The invention claimed is:

1. A manually operated deck cleaning tool for removing debris from the space between adjacent deck planks having upper and lower planar surfaces, said tool comprising:

an elongated handle having first and second ends, said handle adapted to be hand held adjacent said second end during operation;

a blade having opposing planar surfaces, a leading edge, a back edge, a bottom edge, and a trailing edge, said blade having a thickness less than said space between said adjacent deck planks, said blade being attached to the first end of said handle; and wheels for contacting the upper planar surfaces of said adjacent deck planks during operation, said wheels being rotatably attached to said blade between said leading edge and said trailing edge at a location adapted to provide that at least a portion of said leading edge of said blade extends at least to the plane of said lower planar surfaces of said adjacent deck planks during operation.

2. The tool of claim 1 wherein said leading edge of said blade is angled to form a tip at the juncture of said leading edge and said back edge.

3. The tool of claim 2 wherein the angle between said back edge and said leading edge is between about 35 and about 40 degrees.

4. The tool of claim 2 wherein only the tip of said blade extends at least to the plane of the lower planar surfaces of said adjacent deck planks during operation.

5. A deck cleaning tool for removing debris from the space between adjacent deck planks having upper and lower planar surfaces, said tool comprising:

an elongated handle having first and second ends;

a blade having opposing planar surfaces, a leading edge, a back edge, a bottom edge, and a trailing edge, said leading edge of said blade being angled to form a tip at the juncture of said leading edge and said back edge, said blade having a thickness less than said space between said adjacent deck planks, said blade being attached to the first end of said handle; and wheels for contacting the upper planar surfaces of said adjacent deck planks, said wheels being rotatably attached to said blade between said leading edge and said trailing edge;

the ratio of the distance between said tip of said blade and the point of attachment of said wheels to said blade, and the distance between said point of attachment of said wheels to said blade and the second end of said handle is between about 1:12 and about 1:20.

6. The tool of claim 5 wherein said ratio is about 1:16.

* * * * *